United States Patent [19]

Cantryn et al.

[11] Patent Number: 4,895,514

[45] Date of Patent: Jan. 23, 1990

[54] GAS BURNER FOR HEATING OF AN AIR OR OTHER COMBUSTION SUPPORTING GAS STREAM

[75] Inventors: Pierre Cantryn, St Germain-en-Laye; Maurice Idoux, Versailles, both of France

[73] Assignee: Mecanique Generale Foyers-Turbine, Sevres, France

[21] Appl. No.: 256,777

[22] Filed: Oct. 11, 1988

[30] Foreign Application Priority Data

Oct. 23, 1987 [FR] France ..... 87 14686

[51] Int. Cl.[4] ..... F23D 14/46

[52] U.S. Cl. ..... 431/350; 431/354

[58] Field of Search ..... 431/350, 353, 354, 171; 126/116 R; 432/222; 60/749

[56] References Cited

U.S. PATENT DOCUMENTS

| | | | |
|---|---|---|---|
| 2,970,772 | 2/1961 | Boosinger et al. | 431/350 X |
| 3,187,523 | 6/1965 | Kilbourn | 431/350 |
| 3,494,712 | 2/1970 | Vosper et al. | 431/171 |
| 3,649,211 | 3/1972 | Vosper | 431/171 X |
| 3,689,040 | 9/1972 | Reich | 432/222 |
| 3,732,059 | 5/1973 | Goodnight et al. | 431/350 X |
| 3,843,309 | 10/1974 | Lambiris | 431/350 X |
| 4,767,319 | 8/1988 | Vosper | 431/350 |

*Primary Examiner*—Randall L. Green

*Attorney, Agent, or Firm*—Collard, Roe & Galgano

[57] ABSTRACT

A burner for heating a high-velocity stream of a combustion supporting gas comprises a pipe fed with a fuel gas and extending across the flow direction of the combustion supporting gas stream. The pipe defines holes generating fuel gas jets directed in the direction of the combustion supporting gas stream flow, and a flame stabilizer is arranged downstream of the pipe in this direction, the flame stabilizer including two divergent combustion supporting gas stream deflector wings delimiting a downstream zone shielded from said gas stream and an upstream zone. A respective convergent-divergent nozzle is arranged in the downstream zone downstream of each hole and coaxially thereto, the nozzles having inlets facing the holes and the gas jets generated from these holes creating a negative pressure at the nozzle inlets, and the nozzle inlets communicating with the upstream zone through openings so arranged as to eliminate the influence of the dynamic pressure of the gas stream on the flow rate of gas drawn in by the nozzles through the openings.

9 Claims, 2 Drawing Sheets

GAS BURNER FOR HEATING OF AN AIR OR OTHER COMBUSTION SUPPORTING GAS STREAM

The present invention relates to a burner intended to be placed in a duct for heating air or another combustion supporting gas flowing at high speed in said duct and essentially comprising a pipe fed with fuel gas and provided with holes, possibly fitted with injectors, permitting to generate jets of fuel gas directed in the downstream direction, and deflectors fixed on said pipe and serving to deviate the combustion supporting gas stream to create downstream of the manifold a protected zone where the flame can develop.

For stabilizing the flame of such burners it has been proposed to premix, upstream of the combustion zone, a portion of the fuel with a portion of the air or of the combustion supporting gas mixture flowing in the duct, as disclosed, for instance, in U.S. Pat. Nos. 3,494,712 and 3,649,211. In all known devices, the air or the combustion supporting mixture used for premixing is admitted through openings provided in the deflectors or through passageways provided between the deflectors and the pipe, and its flow rate essentially depends on the section of these openings or passageways and on the air or the combustion supporting gas mixture velocity in the duct. The result is that, if one changes the fuel gas flow rate to adapt it to the requirements, or if the flow velocity of the gas to be heated varies, the air factor of the mixture is changed, which may endanger the stability of the flame.

The purpose of the present invention is to remedy this drawback by providing a virtually constant air factor of the air-fuel mixture, in spite of the variations in the fuel flow rate and/or in the velocity of the gas to be heated.

The burner of the present invention includes, downstream of each hole or injector and coaxially to it, a convergent-divergent nozzle so arranged that the fuel gas jet emanating from said hole or injector creates a negative pressure at the inlet of the nozzle, and the inlet of the nozzle is connected with the space inside said duct surrounding the burner by at least one opening positioned so as to eliminate the influence of the dynamic pressure of the gas to be heated on the flow rate of the combustion supporting gas drawn-in through said opening.

According to a preferred embodiment, the space between the pipe and the nozzles is closed by two wall elements fixed on the pipe and arranged approximately parallel to the plane containing the centerlines of the nozzles, on either side of the same, and by a front wall connected to said wall elements and supporting the nozzles, and openings are made in said wall elements. Said front wall can advantageously consist of two wall elements converging in downstream direction and forming a dihedron the edge of which is located in the plane of the conterlines of the nozzles. The deflectors can be connected to said wall elements, and stiffening ribs can be provided to connect the deflectors to said front wall and to the nozzles.

The pipe can advantageously be equipped with injectors the position of which is adjustable so as to permit varying the distance of each injector from the throat of the respective nozzle.

If the oxygen content of the gas to be heated is not sufficient, some of the air required for combustion can be fed in through a conduit surrounding said pipe and partly formed by the flame stabilizer.

If the nitrogen oxide content of the heated gasses must be maintained at a particularly low value, it is possible, according to another characteristic of the invention, to inject only a portion of the fuel gas through the holes or injectors of the pipe, the other portion being injected into the flame of the burner, upstream of it. For this purpose, one can use branch pipes connected to said pipe and extending to the front end of the burner on either side of it or on one side only. Alternately, this auxiliary injection of fuel gas can be implemented by means of one or two pipes provided with holes or fitted with injectors, arranged on one side of the burner or on either side of it, respectively, and connected to the main gas feed pipe.

In case of cast steel construction, the flame stabilizer will advantageouly be of modular construction.

The description hereafter refers to the attached drawings which represent, as non-limiting examples, several preferred embodiments of the invention and on which:

Figure 1:
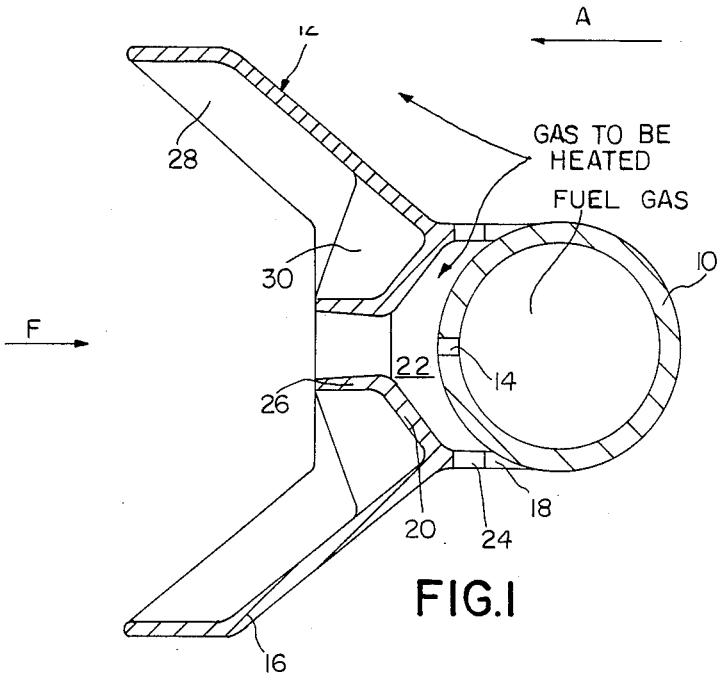
FIG. 1 is a cross sectional view along line A—A of FIG. 2 of a burner according to the invention.
Figure 2:
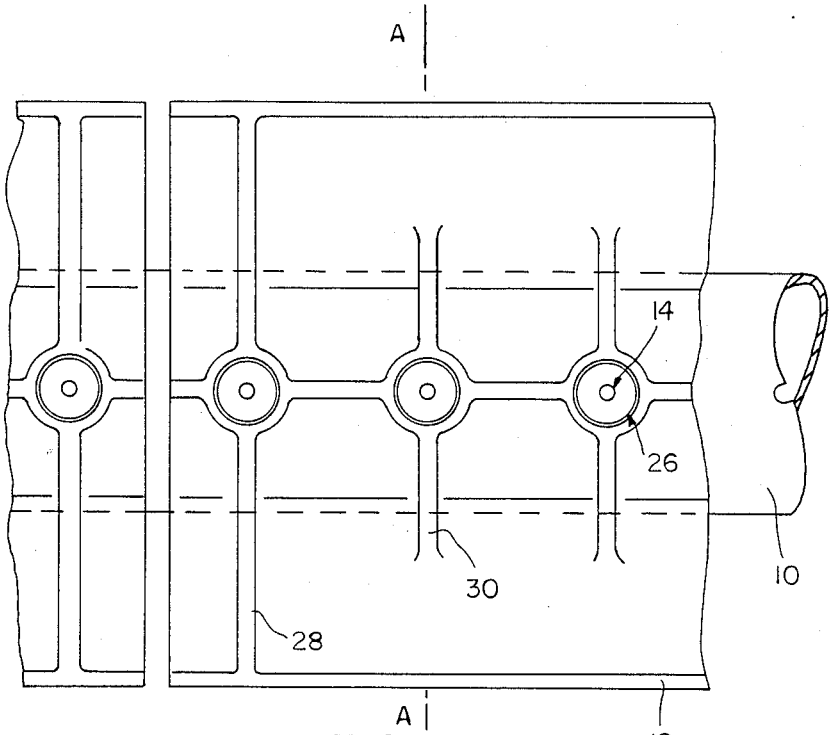
FIG. 2 is a fragmentary view taken in the direction of arrow F of FIG. 1.

The burner of FIGS. 1 and 2 comprises a pipe 10 arranged transversely in a duct the cross section of which is significantly bigger than the one of said pipe and in which air or another oxygen containing gas flows in the direction indicated by arrow A, and a flame stabilizer 12 fixed on pipe 10 at its front end.

Pipe 10 is connected to a pressurized fuel gas source and is provided with calibrated holes 14 through which fuel gas jets are sent downstream in a direction parallel to the direction of flow of the gas to be heated (arrow A).

Stabilizer 12 is fitted with two divergent wings 16 forming deflectors which are connected to pipe 10 by wall elements 18 extending parallel to the direction of flow of the gas stream to be heated; wings 16 are bent at their rear end to stiffen them. The space at the front end of pipe 10 between wings 16 and the pipe is closed by a front wall formed by two convergent wall elements 20 which delimit, together with the pipe, a chamber 22. This chamber can be closed at both ends of the burner by walls perpendicular to the centerline of the pipe, and divided by partitions parallel to these walls. Orifices 24 made in wall elements 18 connect chamber 22 with the space inside the duct in which flows the gas to be heated. Convergent-divergent nozzles 26 are mounted on wall elements 20, coaxially to holes 14 in pipe 10, the centerlines of the nozzles defining a plane parallel to the direction of flow of the air to be heated. The assembly can be stiffened by ribs 28 and 30.

The various stabilizer components can be assembled by welding. The stabilizer can also be formed by identical modular elements fixed side by side on tube 10, for example by welding, each modular element being a single cast part.

In nozzles 26, the energy of the fuel gas jets emanating from orifices 14 is used to draw in a certain flow rate of air or combustion supporting gas through openings 24, and to prepare a flammable mixture burning at the outlet of the nozzles. Thanks to this construction, premixing of the air or of the combustion supporting gas with fuel gas upstream of the nozzle is prevented, and any combustion hazard in this region, and consequently overheating of the walls of chamber 22 and deposit of carbon black, are eliminated.

The ratio of the drawn-in quantity of combustion supporting gas to the quantity of combustion supporting gas required for complete combustion, also called the air factor if the combustion supporting gas is air, depends on the diameter of orifices 14, the diameter of the nozzle throat and the distance of the orifices from the nozzle throat, but it only varies slightly when the flow rate of the combustion supporting gas is changed; this ratio can be fixed by construction at an optimum value. Alternately, pipe 10 can be equipped with injectors the distance from the nozzle throat of which is adjustable to permit the adjustment of the air factor, for instance with a view to modifying the diameter and/or the length of the flame. Thanks to the arrangement of orifices 24 in planes parallel to the direction of flow A of the air or the combustion supporting gas mixture or slightly inclined with respect to this direction, the dynamic pressure of the air has virtually no influence on the air factor, and the operation of the burner is not disturbed by variations in the velocity of the air or combustion supporting gas mixture stream. Other means, namely the use of deflectors located upstream of orifices 24, could be provided to eliminate the influence of the dynamic pressure of the gas to be heated on the gas flow rate drawn-in through the nozzles.

Figure 3:
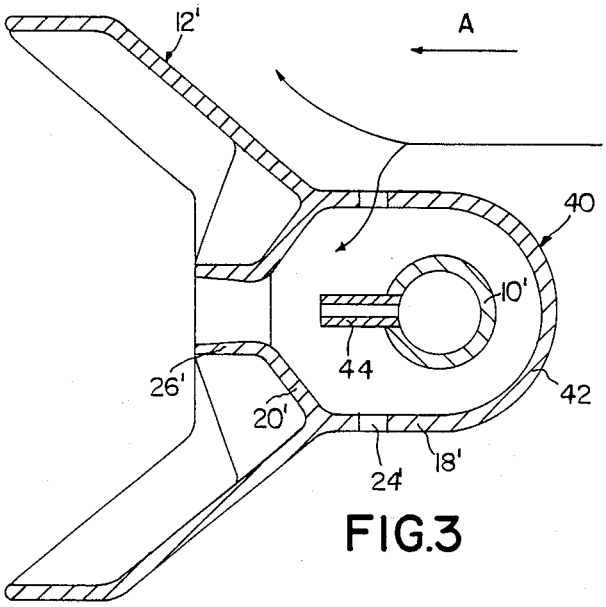
FIG. 3 is a cross sectional view of another embodiment of the invention.

FIG. 3 shows a cross sectional view of an embodiment of the burner according to the invention which can be used when the gas to be heated has a relatively low oxygen content. A portion of the air required for combustion is fed in through a conduit 40, partly formed by the wall elements 18' and 20' of stabilizer 12', and partly by a hemicylindrical shell 42.

The gas feed pipe 10' is located inside conduit 40 and is fitted with injectors 44.

Thanks to the negative pressure created in nozzles 26' by the fuel gas jets generated by injectors 44, a portion of the gas to be heated is drawn-in through openings 24', as well as the air fed in by conduit 40.

Figure 4:
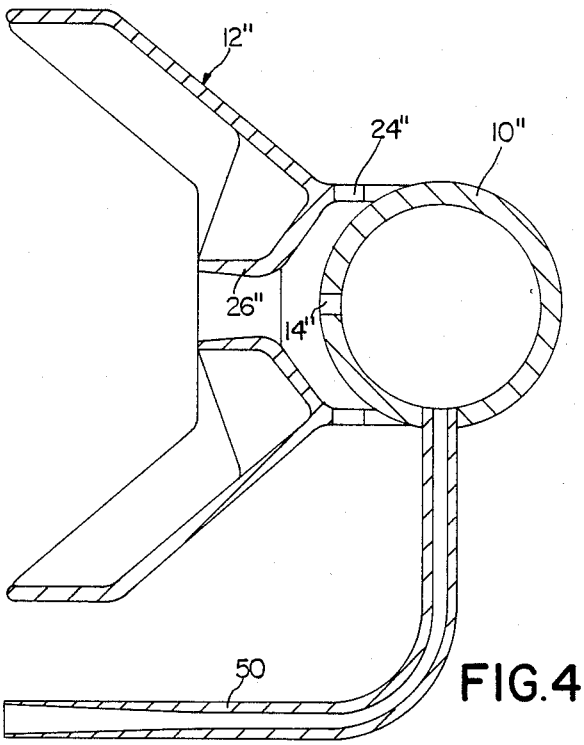
FIG. 4 is a cross section of a modified form of the burner of FIG. 1.

FIG. 4 shows a modified form of the burner of figure 1 which permits to maintain the nitrogen oxide content of the heated gases at a particularly low value. To this end, only a portion of the total fuel gas flow feeding tube 10'' is injected through holes 14'', the other portion being injected at the front end of the burner by means of bent pipes 50 spaced over the whole length of the burner; the end of these pipes which possibly can be fitted with injectors, is approximately in the same plane as the front edge of the wings of stabilizer 12'', and outwards of this wing.

In the example shown, one single line of pipes is provided on one side of the burner, but they could be arranged on either side of the burner. Alternately, the injection of a portion of the fuel gas at the front end of the burner could be implemented by means of one or two pipes provided with holes or fitted with injectors, arranged in a parallel direction to tube 10'', near the edge of one of the wings or of both wings, respectively, of the flame stabilizer, outside it, and connected to tube 10''.

Many changes can be made in the described embodiments, mainly as far as the shapes and the dimensions of the fuel gas feed pipe and of the flame stabilizer and their relative arrangement are concerned, and it is well understood that these modifications and all those resulting from the substitution of equivalent technical means come within the scope of the invention.

We claim:

1. A burner for heating a stream of a combustion supporting gas flowing at high speed in one direction, which comprises (a) a pipe fed with a fuel gas and extending across the flow direction of the combustion supporting gas stream, the pipe defining (1) holes generating fuel gas jets directed in the direction of the combustion supporting gas stream flow, (b) a flame stabilizer arranged downstream of the pipe in this direction, the flame stabilizer including (1) two divergent combustion supporting gas stream deflector wings delimiting a downstream zone shielded from said gas stream and an upstream zone, and (c) a respective convergent-divergent nozzle arranged in the donwstream zone downstream of each one of said holes and coaxially thereto, (1) the nozzles having inlets facing the holes and the gas jets generated from said holes creating a negative pressure at the nozzle inlets, and (2) the nozzle inlets communicating with the upstream zone through openings formed in the flame stabilizer and so arranged as to eliminate the influence of the dynamic pressure of the gas stream on the flow rate of gas drawn in by the nozzles through the openings.

2. The burner of claim 1, further comprising an injector mounted in each of said holes and directed towards the nozzle inlet.

3. The burner of claim 1, wherein the nozzles are spaced from the pipe to define a space therebetween, and further comprising two lateral wall elements connected to the pipe and extending approximately parallel to a plane containing the nozzle axes and a front wall element connected to the lateral wall elements and joined to the nozzles, the wall elements closing the space and said openings being defined in the lateral wall elements.

4. The burner of claim 3, wherein the front wall element is comprised of two walls converging in the downstream direction and forming a dihedron having an apexin a plane defined by the nozzle axes.

5. The burner of claim 3, wherein the deflector wings are integral with the wall elements.

6. The burner of claim 5, wherein the flame stabilizer is comprised of a plurality of modular elements fixed side by side on said pipe, each of the modular elements comprising at least one of said nozzles.

7. The burner of claim 1, further comprising an air feed conduit having a wall enclosing the pipe, the conduit wall being formed partly by two lateral wall elements extending approximately parallel to a plane containing the nozzle axes and a front wall element joined to the nozzles, and said openings being defined in the lateral wall elements.

8. The burner of claim 1, further comprising means for extracting a portion of the fuel gas from the pipe and for injecting the extracted fuel gas portion downstream of the burner in the combustion supporting gas stream.

9. The burner of claim 8, wherein the fuel gas portion extracting and injecting means consists of pipes connected to the pipe fed with the fuel gas, the pipes having free ends arranged approximately in a plane defined by the front edges of the deflector wings outside thereof.

* * * * *